US008931374B2

(12) United States Patent
Chen

(10) Patent No.: US 8,931,374 B2
(45) Date of Patent: Jan. 13, 2015

(54) SOCKET WRENCH

(71) Applicant: Kuo Lung Chen, Taichung (TW)

(72) Inventor: Kuo Lung Chen, Taichung (TW)

( * ) Notice: Subject to any disclaimer, the term of this patent is extended or adjusted under 35 U.S.C. 154(b) by 49 days.

(21) Appl. No.: 13/907,987

(22) Filed: Jun. 3, 2013

(65) Prior Publication Data

US 2014/0352499 A1 Dec. 4, 2014

(51) Int. Cl.
*B25B 13/46* (2006.01)
*B25B 13/06* (2006.01)

(52) U.S. Cl.
CPC ..... *B25B 13/463* (2013.01); *B25B 13/06* (2013.01)
USPC ..... 81/63.1; 81/63.2

(58) Field of Classification Search
USPC ..... 81/60–63.2
See application file for complete search history.

(56) References Cited

U.S. PATENT DOCUMENTS

| | | | | |
|---|---|---|---|---|
| 6,997,084 | B1 * | 2/2006 | Gao et al. | 81/62 |
| 7,225,708 | B2 * | 6/2007 | Chen | 81/63.1 |
| 7,237,459 | B1 * | 7/2007 | Shiao | 81/62 |
| 7,290,465 | B2 * | 11/2007 | Gao et al. | 81/62 |
| 7,380,482 | B1 * | 6/2008 | Chan | 81/63.1 |
| 7,398,710 | B1 * | 7/2008 | Ho | 81/63.1 |
| 7,926,391 | B2 * | 4/2011 | Hu | 81/63.1 |
| 8,230,764 | B1 * | 7/2012 | Lee | 81/63 |
| 8,522,651 | B2 * | 9/2013 | Xu | 81/62 |
| 2006/0254393 | A1 * | 11/2006 | Nagata | 81/63 |
| 2007/0012142 | A1 * | 1/2007 | Shiao | 81/62 |
| 2007/0044594 | A1 * | 3/2007 | Chen | 81/63.1 |
| 2007/0240544 | A1 * | 10/2007 | Hu | 81/63.1 |

* cited by examiner

*Primary Examiner* — Monica Carter
*Assistant Examiner* — Danny Hong

(57) ABSTRACT

A socket wrench includes a handle including a pivotal head including a cylindrical, eccentric recess on a bottom, a cylindrical cavity in a blind end of the eccentric recess, a perimetric opening proximate to the eccentric recess, and a spring depressible detent; a socket drive including a lower projection, upper external ratchet teeth, an annular groove, and an intermediate flange; a hollow drive gear including a circular opening on a bottom, first, second and third posts, first, second and third positioning wells; first and second pawls; and a biasing member disposed and biased between the first pawl and the second pawl.

1 Claim, 6 Drawing Sheets

4-4

5-5

SOCKET WRENCH

BACKGROUND OF THE INVENTION

1. Field of the Invention

The invention relates to socket wrenches and more particularly to such a socket wrench with improved characteristics.

2. Description of Related Art

Socket wrenches are well known hand tools for turning a type of bolt or nut. With a conventional socket wrench a socket of a selected size is attached to the ratchet-head wrench and placed in engagement with a threaded fastener. A handle is provided for driving the socket for either tightening or loosening the fastener. The wrench comprises a ratcheting mechanism which is selectively re-positioned in a position to tighten the fastener or a reverse position to loosen the fastener. In either event, the handle is freely rotatable relative to the socket in an opposed direction. That is, with a right hand threaded fastener and the ratchet positioned in the on-position, the handle will drive the socket in a clockwise rotation but can be moved freely in a counterclockwise direction relative to the socket and vise versa for loosening the fastener.

Notwithstanding a wide variety of typical socket wrenches, the invention is neither taught nor rendered obvious thereby.

SUMMARY OF THE INVENTION

It is therefore one object of the invention to provide a socket wrench comprising an elongated handle comprising a pivotal head including a cylindrical, eccentric recess on a bottom, a cylindrical cavity in a blind end of the eccentric recess, a perimetric opening proximate to the eccentric recess, a spring depressible ball detent on an outer surface, and a through hole through the pivotal head and terminating at an inner surface of the cylindrical cavity; a socket drive comprising a lower projection, upper external ratchet teeth, an annular groove proximate to a top, and an annular flange separating the lower projection from the upper external ratchet teeth; a hollow drive gear comprising a circular opening on a bottom, a first post formed on the bottom, a second post formed on the bottom, a third post formed on the bottom, a first positioning well formed on an inner surface of the drive gear, a second positioning well formed on the inner surface of the drive gear, and a third positioning well formed on the inner surface of the drive gear wherein the drive gear is put on a lower portion of the pivotal head with the bottom of the pivotal head engaging the bottom of the drive gear; the socket drive is inserted through the circular opening with the flange engaging an underside of the socket drive and the external ratchet teeth passing the eccentric recess to partially dispose in the cylindrical cavity; and the first and second posts are disposed in the eccentric recess and the third post is disposed in the perimetric opening; a pin inserted through the through hole and a portion of the annular groove to retain the external ratchet teeth and allow the external ratchet teeth to turn; a first pawl disposed on the bottom of the drive gear and comprising pawl teeth on an inner surface and an inclined end wherein the first pawl has an outer surface moveably engaging the inner surface of the drive gear; a second pawl disposed on the bottom of the drive gear and, as a mirror image of the first pawl, comprising pawl teeth on an inner surface and an inclined end wherein the second pawl has an outer surface moveably engaging the inner surface of the drive gear; and spring means disposed and biased between the first pawl and the second pawl; wherein in an inoperative state, the pawl teeth of the first and second pawls are not in contact with the external ratchet teeth, the spring depressible ball detent is partially retained in the second positioning well, the third post is disposed in a central portion of the perimetric opening, the inclined end of the first pawl is spaced apart from the first post, and the inclined end of the second pawl is spaced apart from the second post; wherein in response to counterclockwise turning the drive gear until being stopped the spring depressible ball detent moves from the second positioning well to the first positioning well, the third post is proximate to one end of the perimetric opening, and the second post riding along the inclined end of the second pawl to cause the pawl teeth of the first pawl to engage the external ratchet teeth and disengage the pawl teeth of the second pawl from the external ratchet teeth respectively such that the handle is allowed to clockwise turn in order to clockwise turn the socket drive, and a next counterclockwise turn of the handle does not turn the socket drive but allows the handle to be re-positioned for another turn; and wherein in response to clockwise turning the drive gear until being stopped the spring depressible ball detent moves from the first positioning well to the third positioning well, the third post is proximate to an other end of the perimetric opening, and the first post riding along the inclined end of the first pawl to cause the pawl teeth of the second pawl to engage the external ratchet teeth and disengage the pawl teeth of the first pawl from the external ratchet teeth respectively such that the handle is allowed to counterclockwise turn in order to counterclockwise turn the socket drive, and a next clockwise turn of the handle does not turn the socket drive but allows the handle to be re-positioned for another turn.

The above and other objects, features and advantages of the invention will become apparent from the following detailed description taken with the accompanying drawings.

DETAILED DESCRIPTION OF THE INVENTION

Referring to FIGS. 1 to 5, a socket wrench in accordance with the invention comprises the following components as discussed in detail below.

Figure 1:
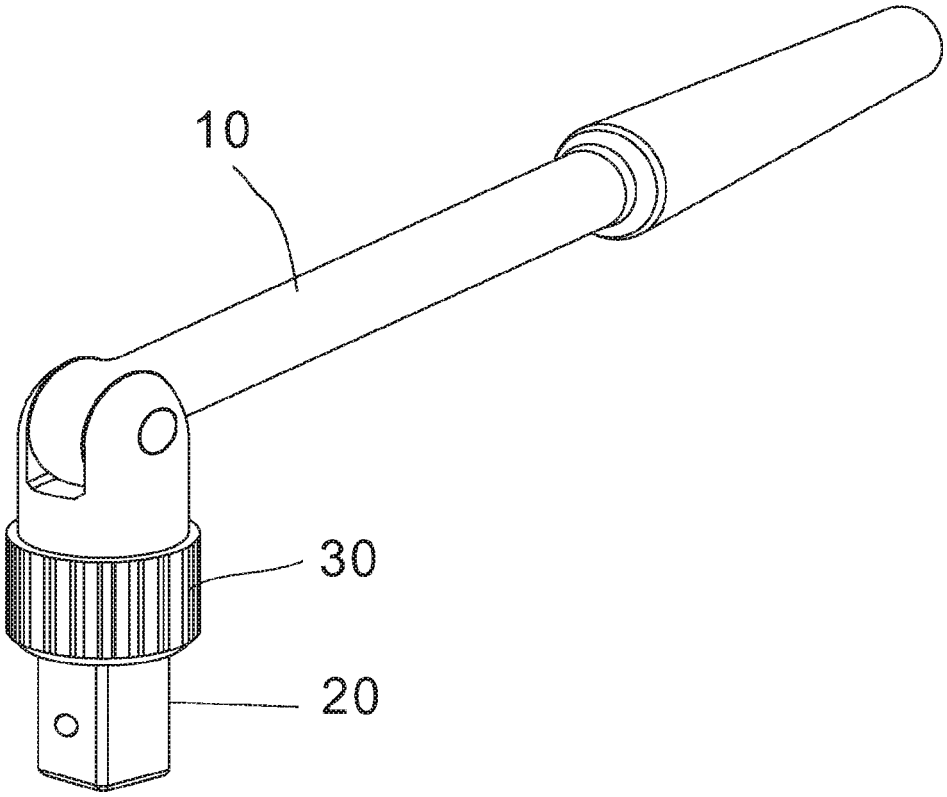
FIG. 1 is a perspective view of a socket wrench according to the invention.
Figure 2:
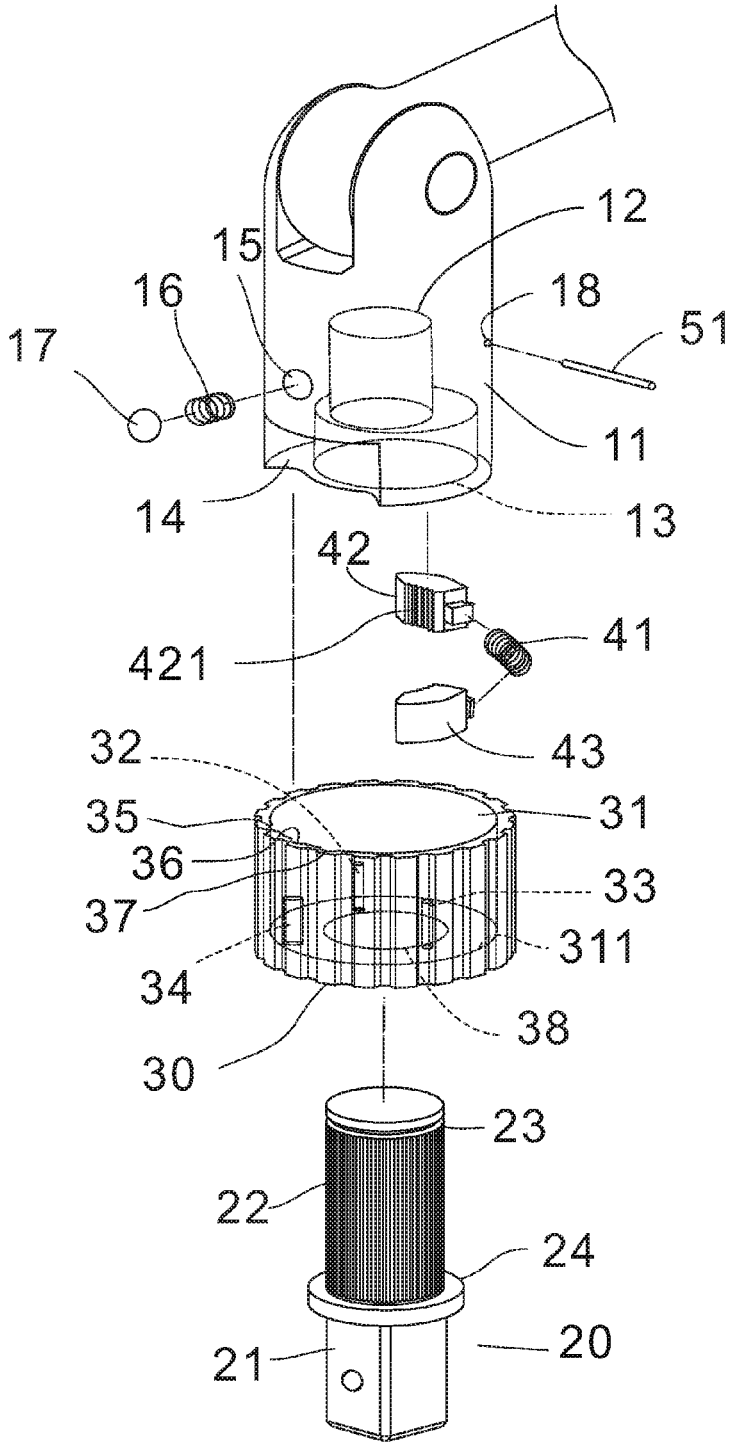
FIG. 2 is an exploded view of the head portion of the socket wrench.
Figure 3:
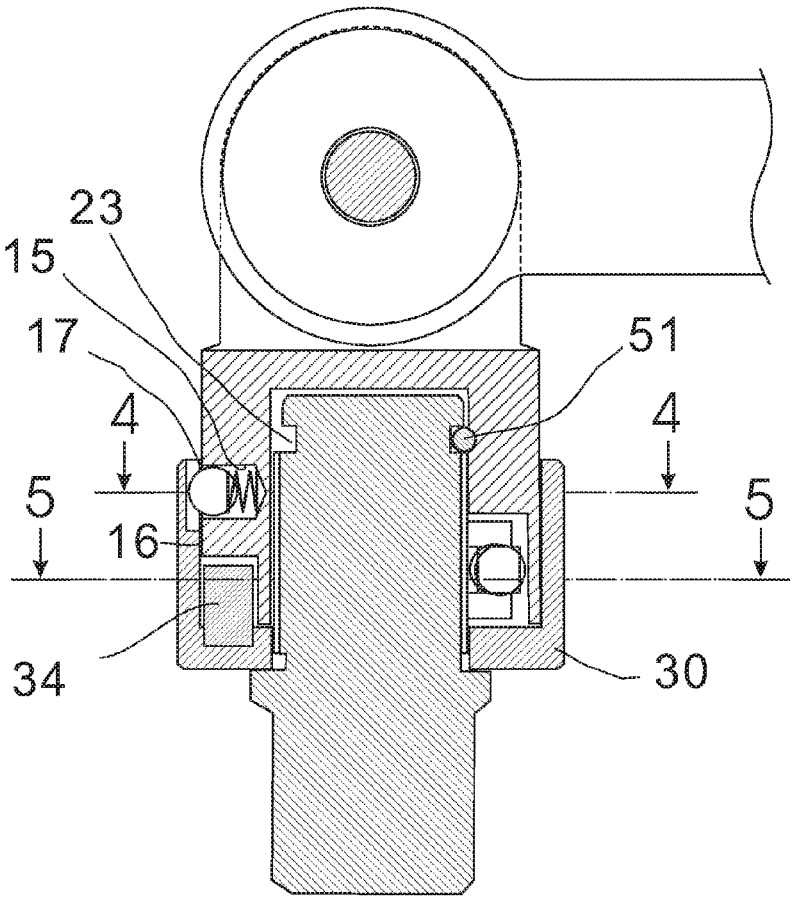
FIG. 3 is a longitudinal sectional view of the head portion of the socket wrench shown in FIG. 1.
Figure 4:
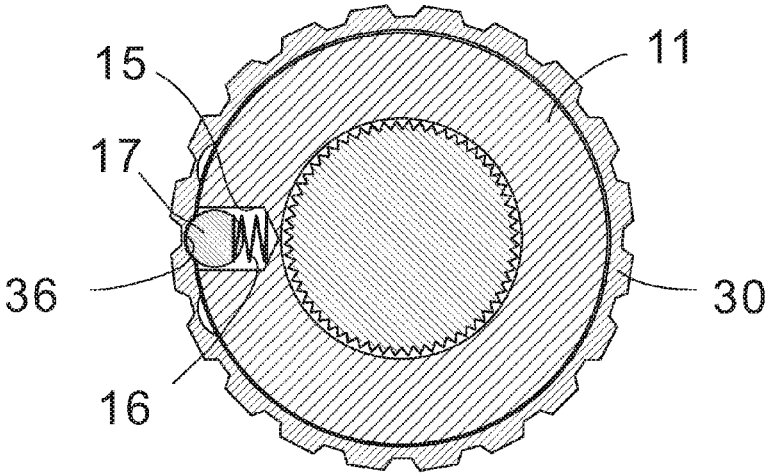
FIG. 4 is a sectional view taken along lines 4-4 of FIG. 3.
Figure 5:
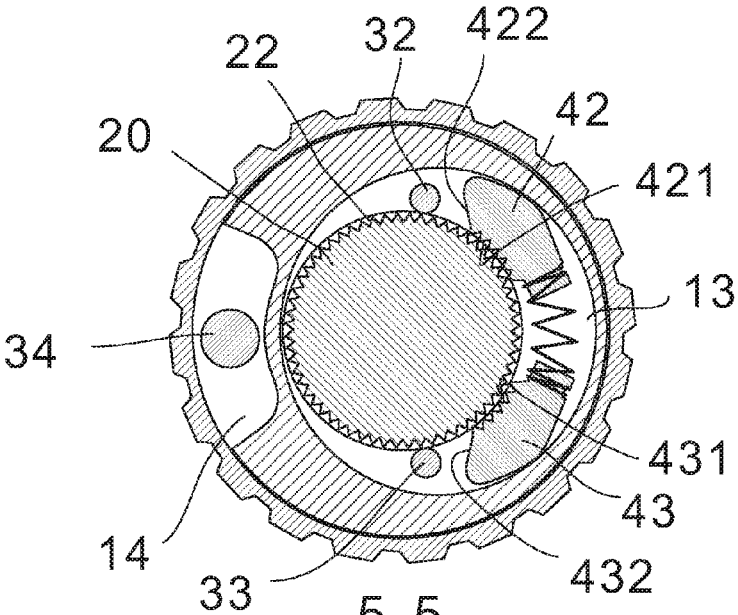
FIG. 5 is a sectional view taken along lines 5-5 of FIG. 3.

As shown in FIG. 1, an elongated handle 10 comprises a pivotal head 11 including a cylindrical, eccentric recess 13 on an end, a cylindrical cavity 12 in a blind end of the eccentric recess 13, a perimetric opening 14 proximate to and being flush with the eccentric recess 13, a receptacle 15 above the perimetric opening 14 and having a blind end proximate to the cylindrical cavity 12, a helical spring 16 disposed in the receptacle 15, a steel ball 17 disposed at an outer end of the spring 16, and a through hole 18 through the head 11 and the periphery of the cylindrical cavity 12.

A socket drive 20 comprises a lower projection 21 for receipt of a fastener engaging socket, upper external ratchet teeth 22, an annular groove 23 proximate a top, and an intermediate, annular flange 24 separating the lower projection 21 from the upper external ratchet teeth 22. A hollow drive gear 30 comprises an internal space 31, a circular opening 38 on a bottom 311, a first post 32, a second post 33, a third post 34, a first positioning well 35, a second positioning well 36, and a third positioning well 37 in which the first, second, and third positioning wells 35, 36, and 37 are formed on an inner surface of the drive gear 30 proximate to a top, and the first, second, and third posts 32, 33, and 34 are formed on the bottom 311. The drive gear 30 is put on a lower portion of the head 11 with the bottom of the head 11 engaging the bottom 311.

The socket drive 20 is inserted through the drive gear 30 until the flange 24 is stopped by an underside of the socket drive 20 and the external ratchet teeth 22 pass the eccentric recess 13 to partially dispose in the cylindrical cavity 12. The first and second posts 32, 33 are disposed in the eccentric recess 13 and the third post 34 is disposed in the perimetric opening 14. A pin 51 is inserted through the through hole 18 and a portion of the groove 23 to retain the external ratchet teeth 22 and allow the external ratchet teeth 22 (i.e., the socket drive 20) to clockwise or counterclockwise rotate.

A first pawl 42 comprises pawl teeth 421 on an inner surface and an inclined end 422. A second pawl 43, as a mirror image of the first pawl 42, comprises pawl teeth 431 on an inner surface and an inclined end 432. A torsion spring 41 is anchored and biased between the first pawl 42 and the second pawl 43. Both the first and second pawls 42, 43 are disposed on the bottom 311. Each of the first and second pawls 42, 43 has an outer surface moveably engaging an inner surface of the drive gear 30.

In an inoperative state (see FIGS. 4 and 5), the pawl teeth 421, 431 are not in contact with the external ratchet teeth 22 respectively. The steel ball 17 is pushed outward by the spring 16 to moveably partially retain in the second positioning well 36, the third post 34 is disposed in a central portion of the perimetric opening 14, the inclined end 422 is spaced apart from the first post 32, and the inclined end 432 is spaced apart from the second post 33. Thus, the handle 10 is allowed to clockwise or counterclockwise turn.

Figure 6:
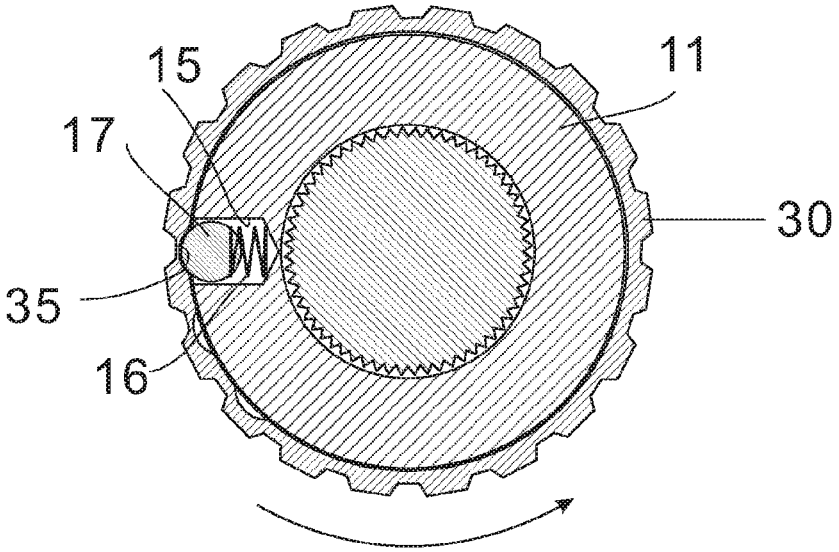
FIG. 6 is similar to FIG. 4 showing the drive gear being counterclockwise turned prior to allowing the wrench to clockwise rotate for tightening a threaded fastener.
Figure 7:
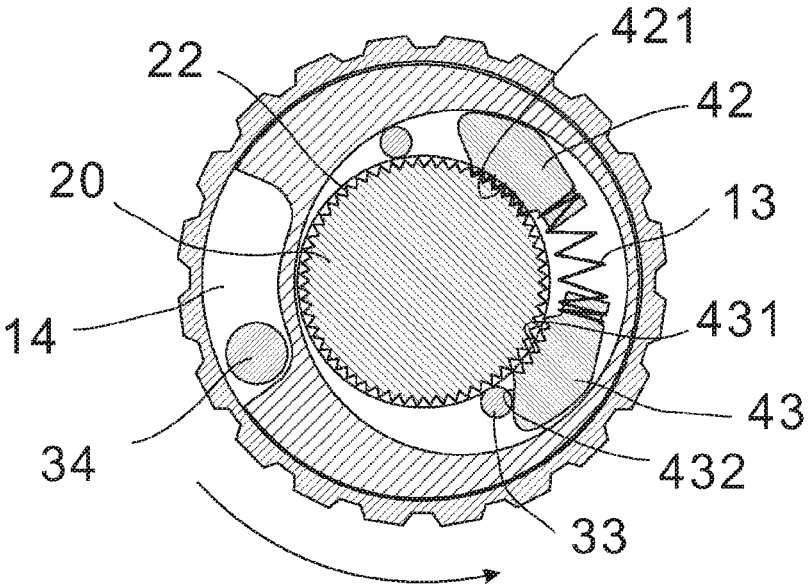
FIG. 7 is similar to FIG. 5 showing the drive gear being counterclockwise turned prior to allowing the wrench to clockwise rotate for tightening the threaded fastener.

Referring to FIGS. 6 and 7 in conjunction with FIGS. 1 to 5, the drive gear 30 is counterclockwise turned until being stopped. Further, a threaded fastener is engaged with a socket which is in turn put on and stayed attached to the lower projection 21. In this position, the steel ball 17 moves to partially retain in the first positioning well 35, the third post 34 is proximate to one end of the perimetric opening 14, and the pawl teeth 421 are in tooth mesh with the external ratchet teeth 22 and the pawl teeth 431 are disengaged from the external ratchet teeth 22 due to a riding of the second post 33 along the inclined end 432. Thus, the socket drive 20 can clockwise rotate without the interference of the ratchet engagement of the pawl teeth 421 with the external ratchet teeth 22. Thereafter, a user may hold and clockwise rotate the handle 10 and thus the socket drive 20 to tighten the attached fastener. A next counterclockwise rotation of the handle 10 will not rotate the socket drive 20 because the pawl teeth 421 do not allow the external ratchet teeth 22 to rotate counterclockwise due to the ratchet engagement, i.e., not turning the fastener but allowing the handle 10 to be re-positioned for another turn while staying attached to the fastener.

Figure 8:
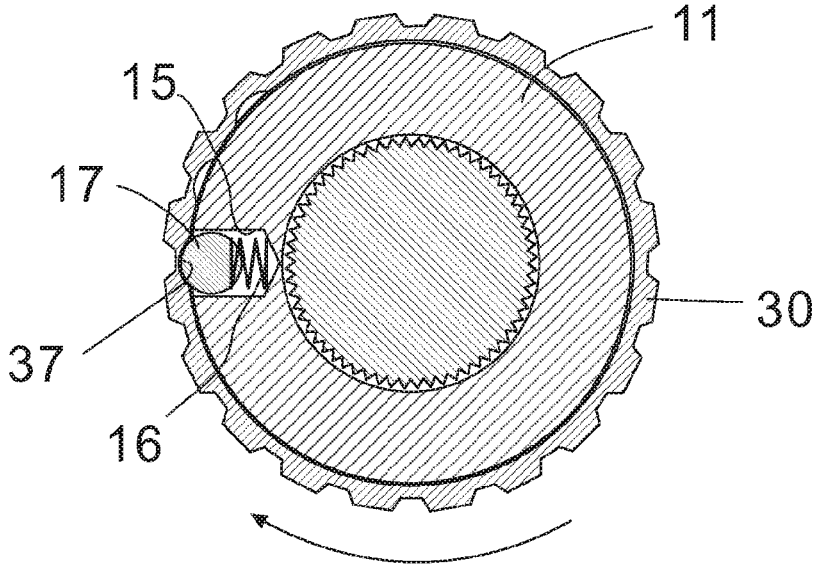
FIG. 8 is similar to FIG. 4 showing the drive gear being clockwise turned prior to allowing the wrench to counterclockwise rotate for loosening the threaded fastener.
Figure 9:
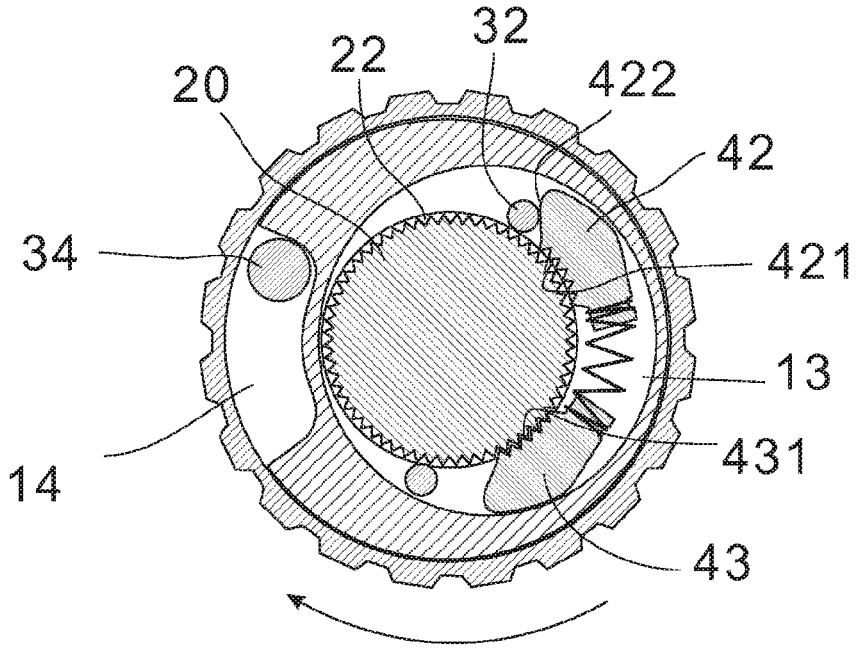
FIG. 9 is similar to FIG. 5 showing the drive gear being clockwise turned prior to allowing the wrench to counterclockwise rotate for loosening the threaded fastener.

Referring to FIGS. 8 and 9 in conjunction with FIGS. 1 to 5, the drive gear 30 is clockwise turned until being stopped. In this position, the steel ball 17 moves to partially retain in the third positioning well 35, the third post 34 is proximate to the other end of the perimetric opening 14, and the pawl teeth 431 are in tooth mesh with the external ratchet teeth 22 and the pawl teeth 421 are disengaged from the external ratchet teeth 22 due to a riding of the first post 32 along the inclined end 422. Thus, the socket drive 20 can counterclockwise rotate without the interference of the ratchet engagement of the pawl teeth 431 with the external ratchet teeth 22. Thereafter, a user may hold and counterclockwise rotate the handle 10 and thus the socket drive 20 to loosen the attached fastener. Further, an immediate next clockwise rotation of the handle 10 will not rotate the socket drive 20 because the pawl teeth 431 do not allow the external ratchet teeth 22 to rotate clockwise due to ratchet engagement, i.e., not turning the fastener but allowing the handle 10 to be re-positioned for another turn while staying attached to the fastener.

While the invention has been described in terms of preferred embodiments, those skilled in the art will recognize that the invention can be practiced with modifications within the spirit and scope of the appended claims.

What is claimed is:

1. A socket wrench comprising:

an elongated handle comprising a pivotal head including a cylindrical, eccentric recess on a bottom, a cylindrical cavity in a blind end of the eccentric recess, a perimetric opening proximate to the eccentric recess, a spring depressible ball detent on an outer surface, and a through hole through the pivotal head and terminating at an inner surface of the cylindrical cavity;

a socket drive comprising a lower projection, upper external ratchet teeth, an annular groove proximate to a top, and an annular flange separating the lower projection from the upper external ratchet teeth;

a hollow drive gear comprising a circular opening on a bottom, a first post formed on the bottom, a second post formed on the bottom, a third post formed on the bottom, a first positioning well formed on an inner surface of the drive gear, a second positioning well formed on the inner surface of the drive gear, and a third positioning well formed on the inner surface of the drive gear wherein the drive gear is put on a lower portion of the pivotal head with the bottom of the pivotal head engaging the bottom of the drive gear; the socket drive is inserted through the circular opening with the flange engaging an underside of the socket drive and the external ratchet teeth passing the eccentric recess to partially dispose in the cylindrical cavity; and the first and second posts are disposed in the eccentric recess and the third post is disposed in the perimetric opening;

a pin inserted through the through hole and a portion of the annular groove to retain the external ratchet teeth and allow the external ratchet teeth to turn;

a first pawl disposed on the bottom of the drive gear and comprising pawl teeth on an inner surface and an inclined end wherein the first pawl has an outer surface moveably engaging the inner surface of the drive gear;

a second pawl disposed on the bottom of the drive gear and, as a mirror image of the first pawl, comprising pawl teeth on an inner surface and an inclined end wherein the second pawl has an outer surface moveably engaging the inner surface of the drive gear; and spring means disposed and biased between the first pawl and the second pawl;

wherein in an inoperative state, the pawl teeth of the first and second pawls are not in contact with the external ratchet teeth, the spring depressible ball detent is partially retained in the second positioning well, the third post is disposed in a central portion of the perimetric opening, the inclined end of the first pawl is spaced apart from the first post, and the inclined end of the second pawl is spaced apart from the second post;

wherein in response to counterclockwise turning the drive gear until being stopped the spring depressible ball detent moves from the second positioning well to the first positioning well, the third post is proximate to one end of the perimetric opening, and the second post riding along the inclined end of the second pawl to cause the pawl teeth of the first pawl to engage the external ratchet teeth and disengage the pawl teeth of the second pawl from the external ratchet teeth respectively such that the handle is allowed to clockwise turn in order to clockwise turn the socket drive, and a next counterclockwise turn of the handle does not turn the socket drive but allows the handle to be re-positioned for another turn; and wherein in response to clockwise turning the drive gear until being stopped the spring depressible ball detent moves from the first positioning well to the third positioning well, the third post is proximate to an other end of the perimetric opening, and the first post riding along the inclined end of the first pawl to cause the pawl teeth of the second pawl to engage the external ratchet teeth and disengage the pawl teeth of the first pawl from the external ratchet teeth respectively such that the handle is allowed to counterclockwise turn in order to counterclockwise turn the socket drive, and a next clockwise turn of the handle does not turn the socket drive but allows the handle to be re-positioned for another turn.

* * * * *